US006690895B2

(12) United States Patent
Oono

(10) Patent No.: US 6,690,895 B2
(45) Date of Patent: Feb. 10, 2004

(54) IMAGE CARRIER AND IMAGE FORMING APPARATUS

(75) Inventor: Michiteru Oono, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/191,284

(22) Filed: Jul. 10, 2002

(65) Prior Publication Data

US 2004/0008998 A1 Jan. 15, 2004

(51) Int. Cl.[7] ..... G03G 15/00

(52) U.S. Cl. ..... 399/26; 369/47.53; 399/38; 399/159

(58) Field of Search ..... 399/26, 159, 162, 399/12, 38, 46, 9, 78; 369/47.53, 53.34

(56) References Cited

U.S. PATENT DOCUMENTS 5,313,254 A * 5/1994 Temple ..... 399/78
5,802,419 A 9/1998 Sakurai et al.
6,269,062 B1 * 7/2001 Minemura et al. ..... 369/47.53
6,345,158 B1 2/2002 Oono

FOREIGN PATENT DOCUMENTS

| | | |
|---|---|---|
| JP | 63-092959 | 4/1988 |
| JP | 09-106227 | 4/1997 |
| JP | 2001-100618 | 4/2001 |
| JP | 2001-215846 | * 8/2001 |

* cited by examiner

*Primary Examiner*—Sophia S. Chen
(74) *Attorney, Agent, or Firm*—Foley & Lardner

(57) ABSTRACT

An image carrier is provided with a support base that has the photosensitive layer, an image forming area for forming an electrostatic latent image and an information recording layer formed in an area except the image forming area on the surface for reading/writing of information by a beam. An image forming apparatus is provided with a detecting unit for optically detecting information recorded on the information recording layer and a controller for identifying the status of the image carrier from the detection result by the detecting unit.

19 Claims, 7 Drawing Sheets

IMAGE CARRIER AND IMAGE FORMING APPARATUS

BACKGROUND OF THE INVENTION

1. Field of the Invention

The present invention relates to an image carrier, an image forming apparatus and an information processing method for easily initializing a processing unit when an image carrier is exchanged on an image forming apparatus.

2. Description of the Related Art

When a photosensitive body that is an image carrier or a processing cartridge that has a photosensitive body is exchanged on an image forming apparatus using an electrophotographic system, the initialization of a processing unit is required for forming an image on a photosensitive body and a time and labor required for inputting information for the initialization. In addition, it is required to accurately judge the life of an photosensitive body or a processing cartridge for efficiently exchange a photosensitive body or a processing cartridge.

So, in U.S. Pat. No. 6,345,158 B1, an image forming apparatus provided with a magnetic recording layer for storing initial characteristic information and using history of a photosensitive body in a drum shape for magnetically reading/writing information on a magnetic recording layer is disclosed. Further, in Japanese Laid-Open Patent Application No. 9-106227, an image forming apparatus with such a non-volatile memory as NVRAM, etc. added to a processing cartridge for storing initial characteristic information of a photosensitive body and using history and for executing the read/write from the main body of the apparatus through electric signals history of a photosensitive body is disclosed.

However, on an image forming apparatus provided with a magnetic recording layer on the former photosensitive body, the photosensitive body is provided opposite to a developing device in the main body of the apparatus and therefore, in the case of a two-component developing system or one-component developing system using magnetic toner, a magnetic roller of the developing device is provided close to the magnetic recording layer. Because of this, the information recorded on the magnetic recording layer may be demagnetized and application of magnetic shield or other countermeasures may be demanded. Further, when a magnetic head to slide on the magnetic recording layer is used for the read/write of information recorded on the magnetic recording layer, the magnetic recording layer may be worn out and it may become necessary to pay attention to its physical durability.

On the other hand, on an image forming apparatus provided with a non-volatile memory to the latter processing cartridge described above, use of a non-volatile memory may increase a cost and become a factor for increasing the number of parts requiring replacement when recycling used processing cartridges.

SUMMARY OF THE INVENTION

It is an object of this invention to provide an image forming apparatus capable of easily obtaining information for the initialization of a processing unit corresponding to characteristics of a photosensitive body when exchanging a photosensitive body or a processing cartridge and for certainly controlling the life of a photosensitive body or a processing cartridge without increasing cost.

According to embodiments of this invention, there are provided plural image carriers each of which comprising: a support base having a photosensitive layer on the surface and an image forming area provided for forming an electrostatic latent image; and an information recording layer formed in an area other than the image forming area on the surface of the support base for reading/writing information.

Further, according to embodiments of this invention, there is provided an image forming apparatus comprising: plural image carriers each of which has a photosensitive layer on its surface and is formed in an area other than the image forming area of the image carrier on which surface an image forming area is provided for forming an electrostatic latent image and reading/writing information by applying beam; a processing unit for executing the image forming process in the image forming area; a detecting unit for detecting information recorded on the information recording layer by applying beam thereto; and a controller for identifying the status of the image carrier from the detection result by the detecting unit.

Further, according to the embodiments of this invention, there is provided an image forming apparatus comprising: plural image carriers having the information recording layers for reading/writing information by applying beam that are formed in areas other than the image forming area having the photosensitive layers on the surfaces for forming electrostatic latent images thereon; plural processing units for executing the image forming process in the image forming areas of the plural image carriers; plural detection units for detecting information recorded on the information recording layers by applying beam thereto; and controllers for identifying the status of the plural image carriers according to the detection results of the detection units.

DETAILED DESCRIPTION OF THE INVENTION

Figure 1:
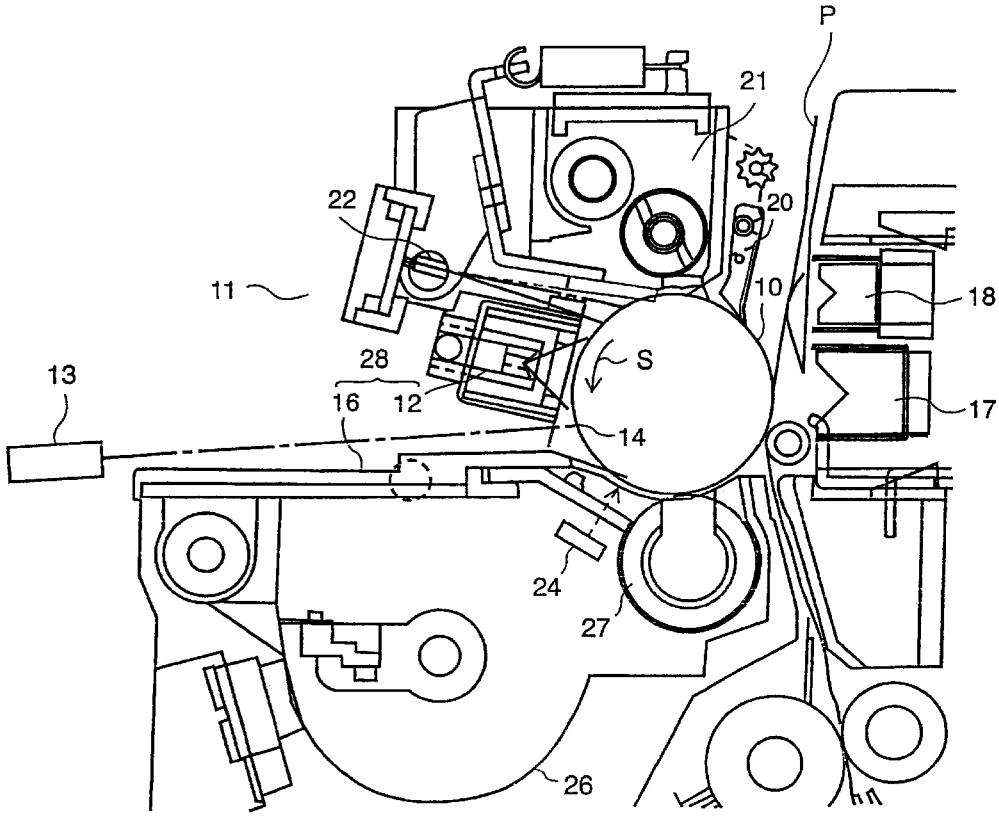
FIG. 1 is a block diagram showing a photosensitive drum and processing units of an image forming apparatus in a first embodiment of this invention.

Preferred embodiments of this invention will be described below in detail referring to the attached drawings. FIG. 1 shows a photosensitive drum 10 that is an image carrier and a processing unit 11 that executes the image forming process on the photosensitive drum 10 of an image forming apparatus in the first embodiment of this invention. Around the photosensitive drum 10, a main charger 12 that is a charger to uniformly charge the photosensitive drum 10 along its rotating direction S, an exposure unit 14 to which a laser beam is applied from an exposure unit 13 for forming a latent image on the charged photosensitve drum, a developing unit 16, a transferring charger 17, a separation charger 18, a separation claw 20, a cleaner and a charge elimination lamp 22 are provided successively to form the processing unit 11. Between the exposure unit 14 and the developing unit 16, there is provided an optical head 24 that is a detecting unit. Further, the processing unit 11 may not include the above-mentioned main charger 12 and all other devices.

The developing unit 16 is provided with a developing roller 27 in a casing 26 containing a two-component developing agent (not illustrated)) and provided with a stirring roller (not illustrated) opposite to the photosensitive drum 10 for stirring and conveying a two-component developing agent.

The photosensitive drum 10, the developing unit 16 and the main charger 12 are joined in one unit, that is, a processing cartridge 28. This processing cartridge 28 is detachable in one unit from the main body of the image forming apparatus.

Figure 2:
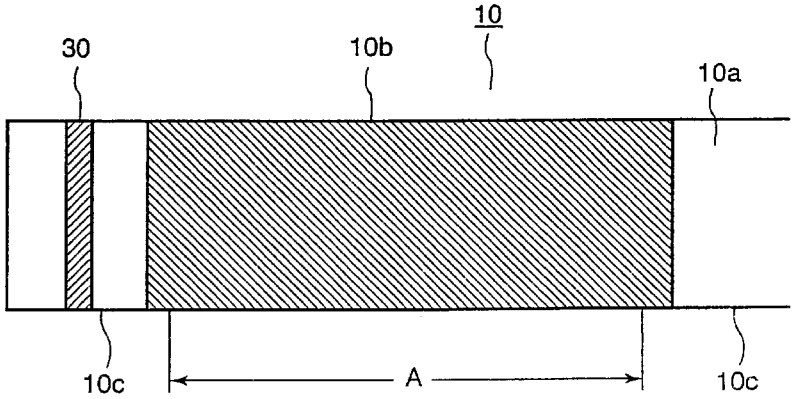
FIG. 2 is a front view showing a photosensitive drum in a first embodiment of this invention.

The photosensitive drum 10 has an amorphous silicon photosensitive layer 10*b* formed at the almost central portion of a support base, for example, an aluminum made conductive base pipe 10*a* as shown in FIG. 2. The inside of the photosensitive layer 10*b* away from both sides of the photosensitive layer 10*b* for a certain distance is an image forming area [A]. On the photosensitive drum 10, an information recording layer 30 is formed on one of the base pipe 10*a* of a portion 10*c* without forming the photosensitive layer 10*b* that is an area other than the image forming area [A] for the read/write of information by applying beam. This information recording layer 30 is made of phase change recording material.

Figure 3:
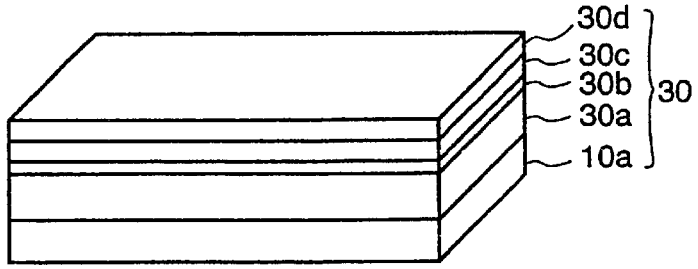
FIG. 3 is a perspective view showing the structure of an imformation recording layer in the first embodiment of this invention.

This information recording layer 30 is in the same structure as those used in such optical recording media as CD-RW, DVD-RAM that can be rewritten. The information recording layer 30 is formed by coating a protective layer 30*a* comprising ZnS and SiO2 and a recording layer 30*b* comprising GeTe, Sb2Te3 and Sb that are well-known phase change recording materials on the base pipe 10*a* and further, by coating a protective layer 30*c* comprising ZnS and SiO2 and an overcoat layer 30*d* over there as shown in FIG. 3.

Figure 4:
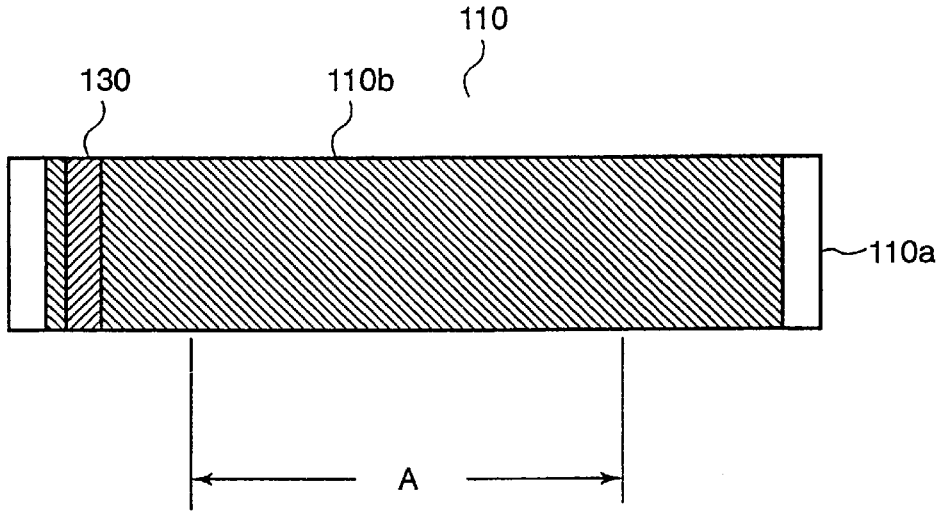
FIG. 4 is a front view showing another example of the photosensitive drum in the first embodiment of this invention.

This information recording layer 30 can be in a size sufficient to record required information, formed on a part of or the entire circumferential direction of the photosensitive drum 10 and in a width more than an optically recording width of the optical head 24. Further, if there is no problem on the separation characteristic, an information recording layer 130 may be formed on a photosensitive layer 110*b* at the outside of the image forming area A instead of a base pipe 110*a* exposure portion of a photosensitive drum 110 as shown in FIG. 4.

Figure 5:
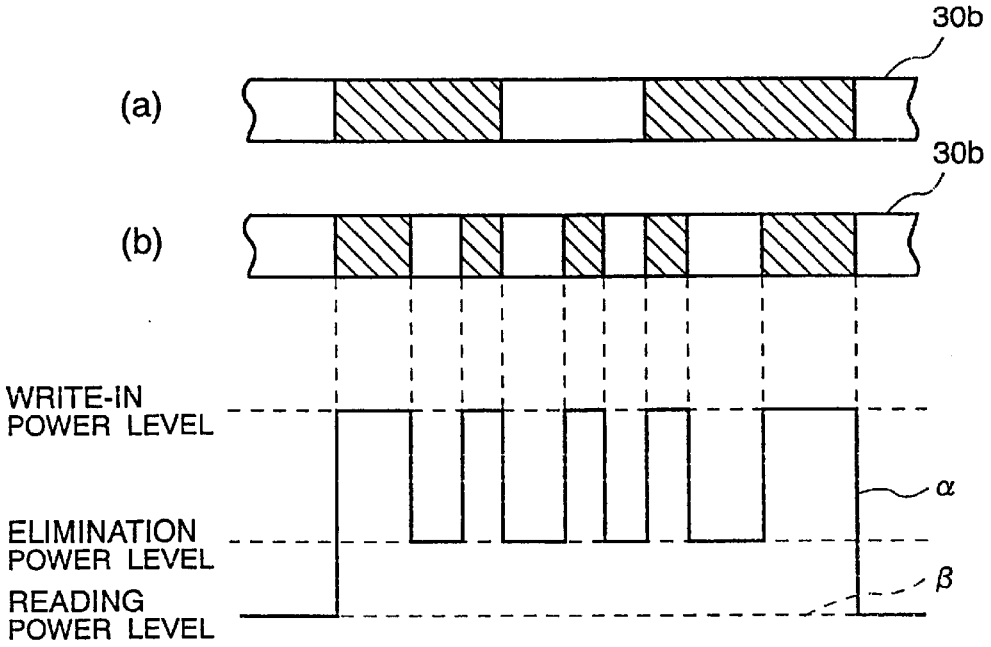
FIG. 5 is a diagram for explaining the relation between information recorded on the information recording layer in the first embodiment of this invention and a power level of applied beam for reading/writing information.

The phase change recording material of the recording layer 30*b* composing the information recording layer has a characteristic to repeat crystallization/amorphous by the optical application of laser beam, etc. and when writing information thereon, beam of power sufficient to make the material amorphous should be applied to the layer. On the other hand, when erasing recorded information, beam of power weaker than that to the information recording layer 30 to return the recording layer 30*b* to the crystal state. For example, as shown in FIG. 5, when a beam shown by a solid line α was first applied to the recording layer 30*b* recording the information as shown in (a), the information recorded in the area applied with a strong writing power level beam is made amorphous and the area applied with a weaker erasing power level beam is returned to the crystal state. As a result, the recording layer 30*b* is rewritten as shown by (b) in FIG. 5. The white ground portions of (a) and (b) in FIG. 5 show the crystal areas and the hatched portions show the amorphous areas.

Further, to read and reproduce information recorded on the recording layer 30*b*, apply the reading power level beam shown by the dotted line β in FIG. 5 weaker than the erasing time so as not to change the phase and read out the information according to the reflecting beam differing from the crystal or amorphous state of the recording layer 30*b*.

Figure 6:
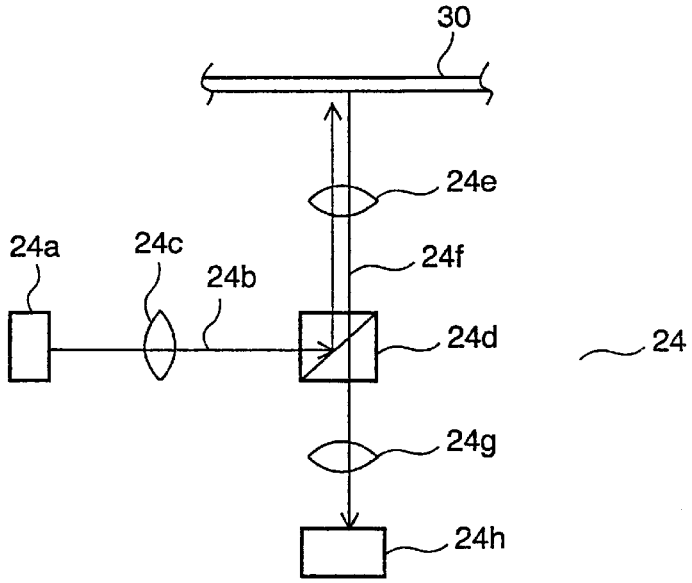
FIG. 6 is a diagram showing an optical head in the first embodiment of this invention.

The optical head 24 that is a detecting unit to read/write information recorded on the information recording layer 30 has a source of laser beam 24*a* to oscillate desired power level laser beam, a collimate lens 24*c* to make the laser beam 24*b* from the source of laser beam 24*a* to a parallel beam, a hologram 24*d* to deflect the parallel beam from the collimate lens 24*c*, an objective lens 24*e* to focus the beam from the hologram 24*d* to the information recording layer 30, a detection lens system 24*g* to focus the reflecting beam 24*f* from the information recording layer 30, and a detection element 24*h* to read the reflecting beam 24*f* as shown in FIG. 6. A gap between the information recording layer 30 and the optical head 24 is provided to secure a proper distance corresponding to optical characteristics of the objective lens 24*e*.

For information recorded in the information recording layer 30, initial information of the photosensitive drum 10 is recorded at the stage when the photosensitive drum 10 is not yet used. The initial information includes high output voltage to be supplied to the main body of the image forming apparatus, for example, the main charger 12 and a correction amount of image processing parameter, and a count value expressing the using information of the photosensitive drum 10 ("0" as not used). The correction value of the image processing parameter is the optimum value to determine the relation of, for example, density of an original document and density of an image that is output.

Figure 7:
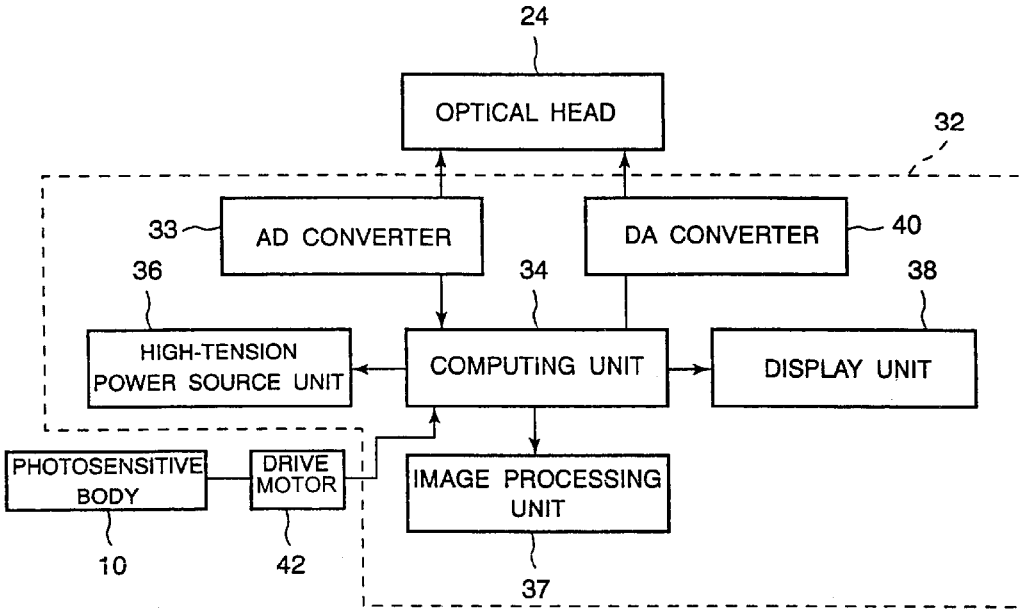
FIG. 7 is a block diagram showing a controller in the first embodiment of this invention.

FIG. 7 shows a block diagram of a controller 32 which identifies the state of the photosensitive drum 10 according to the result of detection from the information recording layer 30 by the optical head 24 and judges the life of the photosensitive drum 10 while initializing the processing unit 11. The controller 32 has an AD converter for input information from the optical head 24 that executes the reading/writing, a computing unit 34 that processes information from the AD converter 33, and a DA converter 40 for updated information of the information recording layer 30 obtained from the computed result. The controller 30 binarizes initial information read by the optical head 24 from the information recording layer 30 on the photosensitive drum 10 by the AD converter 33 and inputs the binary information into the computing unit 34. In the computing unit 34, high output voltage and image processing parameter are changed based on the input binary information. Of the changed results, the high output voltage value is input into a high-tension power source unit 36 and controls high output voltage of the main charger 12, and the image processing parameter value is input into an image processing unit 37 that controls the exposure unit 13 and the developing device 16 and adjusts toner density of the developing device 16. With this, when necessary, prescribed information pertaining to the main charger 12 or the developing device, etc. are displayed on a display unit 38.

On the other hand, updated information of the photosensitive drum 10 is input into the computing unit 34 through the main control unit (not illustrated) of the main body of the apparatus and the obtained result is converted in the DA converter 40, and the information of converted result is input into the optical head 24. The optical head 24 oscillates the laser beam shown by the solid line α in FIG. 5 based on the converted result information and records the updated information on the information recording layer 30 on the photosensitive drum 10. For example, regarding the updated information of using history data of the photosensitive drum 10, the operation time of a drive motor 42 for rotating the photosensitive drum 10 is counted by the computing unit 34, the obtained count result is converted in the DA converter 40 and the data of the converted result is input into the optical head 24 and the using history of the photosensitive drum is updated by the oscillation of laser beam from the optical head 24.

Next, actions of the image forming apparatus will be described. When a print key (not illustrated) of the main body is depressed for starting the print (copy) operation by the image forming apparatus, the photosensitive drum 10 is rotated in the arrow direction s shown in FIG. 1 by the drive motor (not illustrated) and a toner image is printed on the image forming area [A] through the main charger 12, the exposure unit 14 and the developing device 16. Then, the toner image is transferred on a paper P by the transferring charger 17 and the paper P is separated from the photosensitive drum 10 by the separation charger 18. After separated from the photosensitive drum 10, the paper P passes through a fixing device (not illustrated) for fixing the image and is discharged. Further, when the photosensitive drum 10 passes the separated charger 18 and residual toner is removed by the cleaner 21, charge is eliminated by the charge elimination lamp 22 and the apparatus becomes ready for the next print operation.

Next, the information reading/writing operation for the information recording layer 30 on the photosensitive drum 10 during the print operation will be explained referring to the flowchart shown in FIG. 8.

When the print key is depressed to start the print operation (S1), the drive motor 32 that rotates the photosensitive drum 10 starts to run (S2). With the rotation of the photosensitive drum 10, the optical head 24 reads information recorded on the information recording layer 30 on the photosensitive drum 10 (S3), and the computing unit 34 counts up the operation time of the drive motor 42 (S4). According to the recorded information read in Step (S3), a value of high output voltage and a an image processing parameter set value that are applied to the main charger 12 are corrected (S5). Based on this corrected print conditions, the print (copy) operation in the number of sheets set by a user is executed (S6 and S7).

At the time when the print operation is completed, the driving time of the drive motor 42 is read and accumulated count results are used as updated information of the using history data of the photosensitive drum 10 and this count result is written onto the information recording layer 30 of the photosensitive drum 10 by the optical head 24 (S8). The accumulated value of drive time of the drive motor 42, that is, a rotating distance of the photosensitive drum 10 is a parameter to know deterioration caused by he use of the photosensitive drum 10, and at the time when the count result reaches a prescribed value, whether the photosensitive drum 10 reaches its life is judged (S9).

When the photosensitive drum 10 is judged to reach its life in Step (S9), a user is notified by displaying that the photosensitive drum 10 or the processing cartridge 28 including the photosensitive drum 10 should be exchanged with new one on the display 38 (S10). Then, the print operation is terminated and the drive motor 42 is stopped (S11). When it was judged that the photosensitive drum 10 does not yet reach the life in Step (S9), the print operation is terminated without displaying nothing on the display 38 and the drive motor 42 is stopped to run (S11).

When the display 38 displays that the photosensitive drum 10 reaches its life, take the processing cartridge 28 out of the main body of the image forming apparatus and when the main charger 12 and the developing device 16 do not reach its life, respectively, exchange the photosensitive drum 10 only and install the processing cartridge to the main body of the apparatus. When both the main charger 12 and the developing device 15 have reached the life, exchange the processing cartridge 28 with a new unit.

When the photosensitive drum 10 or the processing cartridge 28 was exchanged, a high output voltage value and an image process parameter set value that are adaptable to characteristic of a new photosensitive drum 10 and to be applied to the main charger 12 are corrected (S5) by reading information recorded on the information recording layer 30 on a new photosensitive drum 10 by the optical head 24 (S3) and according to the recorded information of a new photosensitive drum read in Step (S3).

According to this first embodiment, a information recording layer 30 for the optical read/write is provided on the photosensitive drum 10, information relative to characteristic and using history of the photosensitive drum 10 are recorded, and at the time of the print operation, the life of the photosensitive drum 10 can be judged by controlling the processing unit 11 by reading the characteristic of the photosensitive drum 10 or writing the using history by the optical head 24.

Accordingly, it is easy to obtain information for the initialization when the photosensitive drum 10 or the processing cartridge is exchanged and accurately detect the lift period of the photosensitive drum 10. Furthermore, the information recording layer 30 is not affected magnetically by the developing device 16, such countermeasures as magnetic shielding, etc. become unnecessary and thus, a low cost can be achieved. In addition, a gap is formed between the information recording layer 30 and the optical head 24 for performing the information read/write, and wear of the information recording layer 30 caused as a result of the sliding with the optical head can be prevented.

Further, it is not needed to provide an expensive non-volatile memory to the processing cartridge 28 and cost increase does not result. When the life of the photosensitive drum 10 of the processing cartridge 28 is exhausted and the photosensitive drum 10 only is exchanged, information needed for initializing is available from the information recording layer 30 on the photosensitive drum and parts other than the photosensitive drum 10 can be recycled and the number of parts requiring replacement is minimized.

Next, the second embodiment of this invention will be explained. In this second embodiment, the reading of the information recording layer in the first embodiment is made by the optical head while the exposure beam of the exposure unit is used for writing on the information recording layer. Therefore, in this second embodiment, the same portions as the structure explained in the first embodiment will be assigned with the same reference numerals and the detailed explanation thereof will be omitted.

Figure 9:
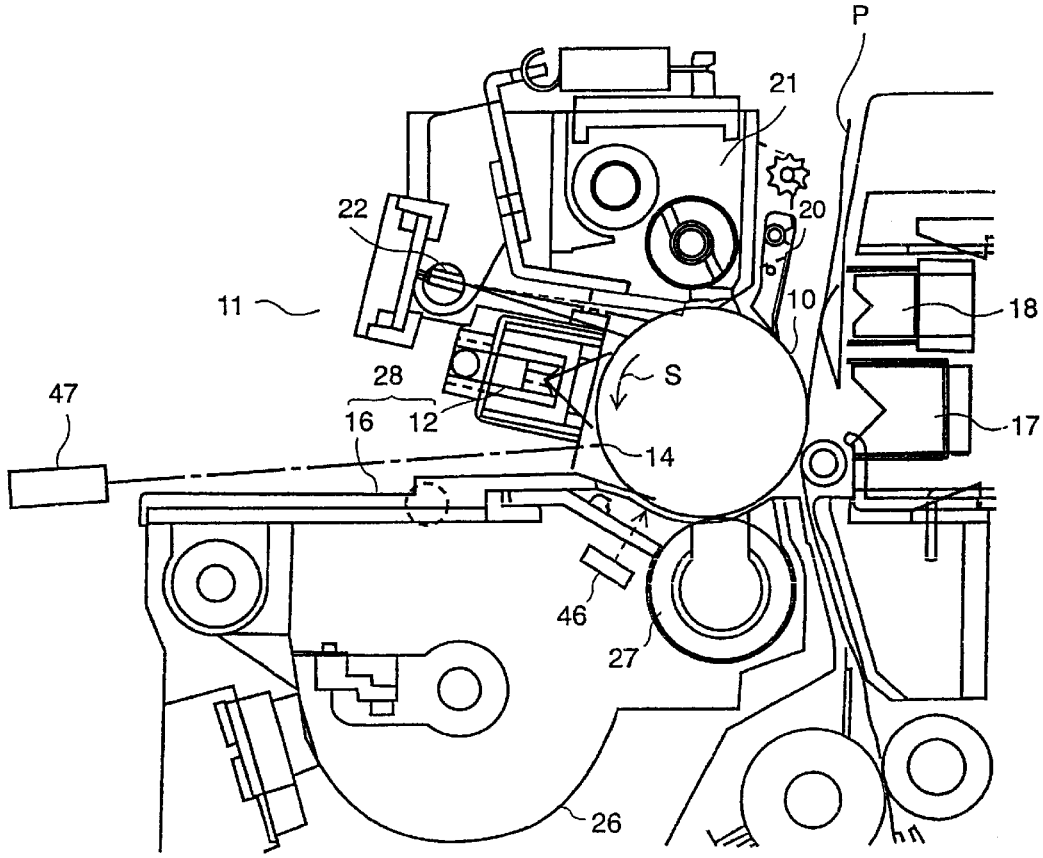
FIG. 9 is a diagram showing a photosensitive drum and processing devices in an image forming apparatus in a second embodiment of this invention.

A read-only optical head 46 (as shown in FIG. 9) that is a detecting unit provided between the exposure unit 14 and the developing device 16 has a function only for reading and reproducing information recorded on the information recording layer 30, and a source of beam of the read-only optical head 24 has a weak power level shown by the dotted line β in FIG. 5. The exposure unit 47 applies a laser beam to the image forming area [A] of the photosensitive drum 10 for forming an electrostatic latent image and further, applies a laser beam of strong write-in power level shown by the solid line α in FIG. 5 or a laser beam of weaker power level than that for writing using history of the photosensitive drum 30 to the areas other than the image forming area [A] of the photosensitive drum 10.

Figure 10:
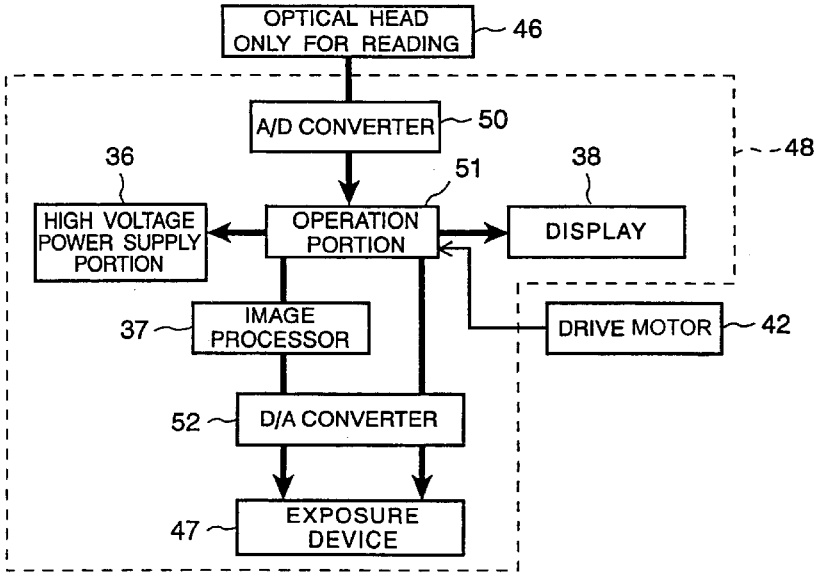
FIG. 10 is a block diagram showing a controller in the second embodiment of this invention.

FIG. 10 shows a block diagram of a controller 48 that identifies the status of the photosensitive drum 10 according to the result of detection from the information recording layer 30 by the read-only optical head 46, control the initialization of the processor 11 and judges the life of the photosensitive drum 10. The controller 48 has an AD converter 50 for input information from the read-only optical head 46 and a computing unit 51 for processing information from the AD converter 50.

The controller 48 inputs the initial information that is read by the read-only optical head 46 from the information recording layer 30 on the photosensitive drum 10 into the computing unit 51 after binarized by the DA converter 50 likewise the first embodiment. In the computing unit 51, the high output voltage and image processing parameter are changed according to the input initial information and the high output voltage value is input into a high-tension power source unit 36 and an image processing parameter value is input into an image processing unit 37. Then, prescribed information accompanied with this process is displayed on a display unit 38.

Further, the counted result of the operation time of the drive motor 42 and the processed power level of laser beam from the image processing unit 37 are converted in the DA converter 52, the data of converted results are input into an exposure device 47, and the using history of the photosensitive drum 10 is updated by the oscillation of the laser beam from the exposure device 47.

According to the second embodiment, the information recording layer 30 is provided on the photosensitive drum 10 for information reading/writing by the beam likewise the first embodiment and therefore, information for initialization when exchanging the photosensitive drum 10 can be obtained easily and the life period of the photosensitive drum 10 can be accurately detected. Furthermore, the information recording layer 30 does not require the countermeasure against magnetism, the low cost can be achieved and wear resulting from the sliding with the optical head 24 can be prevented. In addition, in the processing cartridge 28, the photosensitive drum 30 only can be exchanged and parts requiring replacement can be minimized. Further, the laser beam from the exposure device 13 is also used for the information writing to the information recording layer 30, and for the optical head 46, a relatively cheap optical head of low laser power is usable.

Next, the third embodiment of this invention will be explained. In this third embodiment, plural photosensitive drums used in the first embodiment are provided for a quadruple type tandem system image forming apparatus, and the same component elements as those explained in the first embodiment are assigned with the same reference numerals and the detailed explanation thereof will be omitted.

Figure 11:
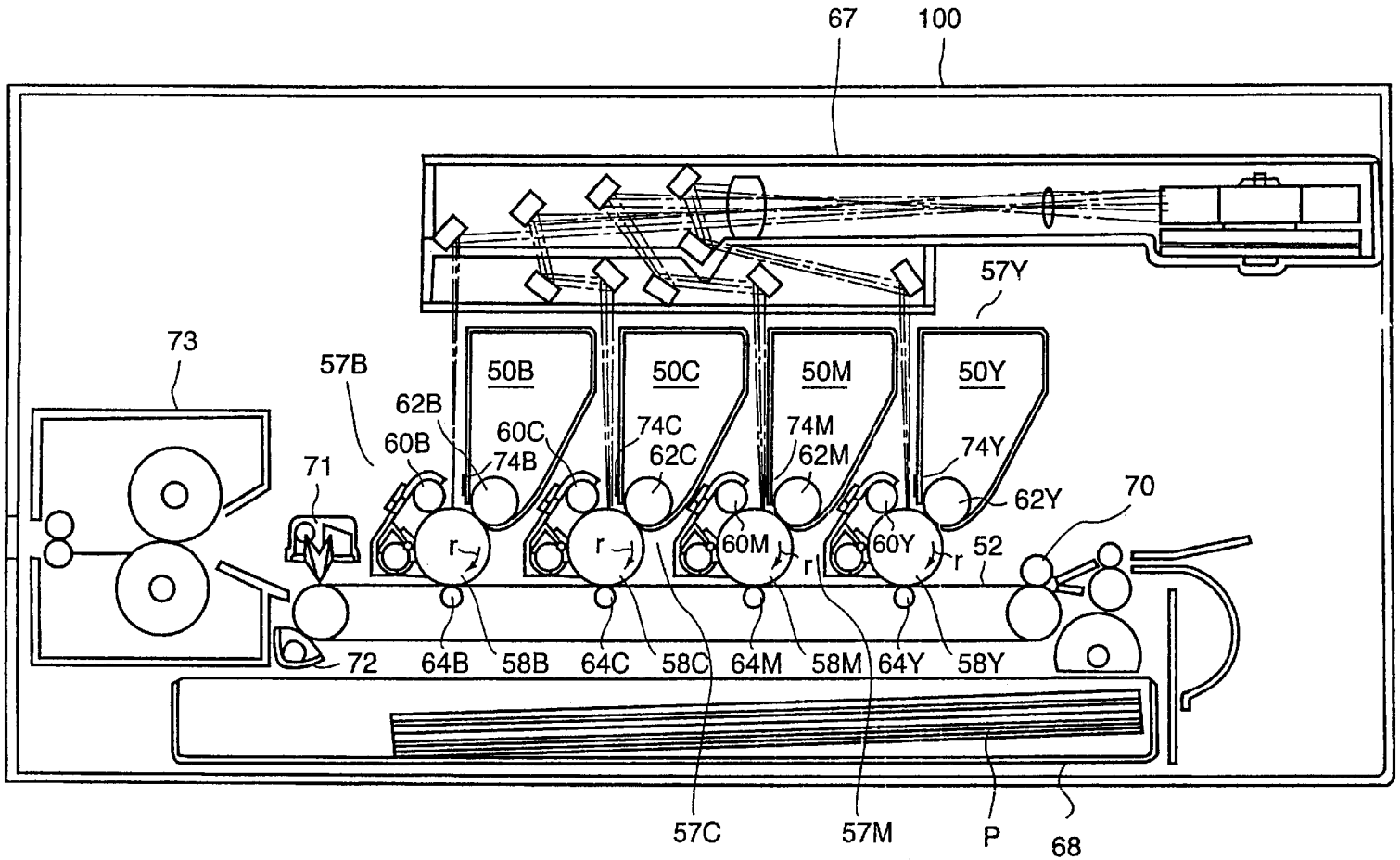
FIG. 11 is a diagram showing the structure of an image forming apparatus in a third embodiment of this invention.

In a quadruple tandem type image forming apparatus 100 shown in FIG. 11, plural image forming units 50Y, 50M, 50C and 50B provided with processing units 57Y, 57M, 57C and 57B are arranged around photosensitive drums 58Y, 58M, 58C and 58B for yellow, magenta, cyan and black along a transfer belt 52.

The processing units 57Y–57B arranged around the photosensitive drums 58Y–58B are provided with main chargers 60Y, 60M, 60C and 60B, developing devices 62Y, 62M, 62C and 62B for developing the photosensitive drums 58Y~58*b* in yellow, magenta, cyan and black developers, and transferring rollers 64Y, 64M, 64C and 64B, respectively. Further, the processing units 57Y~57B have an exposure device 67 that applies laser beams divided into respective colors at the exposure positions of the photosensitive drums 58Y–58B. Below the transferring belt 52, a paper supply cassette 68 is provided for housing paper that is conveyed along the transfer belt 52. Further, around the transferring belt 52, there are provided a charging roller 70, a separation charger 71 and a cleaning device 72 and at the downstream side in the conveying direction of paper P of the transferring belt 52, a fixing device 73 is provided.

The same information recording layer 30 as that formed on the photosensitive drum in the first embodiment is formed on each of photosensitive drums 58Y–58B. On the information recording layer 30, initial information peculiar to the photosensitive drums 58Y–58B, using history, kind of using developing agent, etc. are recorded. Further, optical heads 74Y, 74M, 74C and 74B for reading/writing information recorded on the information recording layer 30 are provided between the exposure unit and developing devices 62Y–62B.

When the print key is depressed and the printing (copying) operation is started on the image forming apparatus 100, the photosensitive drums 58Y–58B are rotated in the arrow direction r in the image forming unit 50Y–50B, and yellow, magenta, cyan and black toner images are formed on the image forming areas [A] of the photosensitive drums 58Y–59B via main chargers 60Y–60B, the exposure device and developing devices 62Y–62B. Thereafter, the toner images formed on the photosensitive drums 58Y–58B are transferred in order on a paper P being conveyed on the transfer belt 52, and full color toner images are formed on the paper P. Then, the paper P is separated from the transfer belt 52 by a separation charger 71, the toner images are fixed by heating in a fixing device 73 and after completing a full color image, the paper is discharged.

Figure 8:
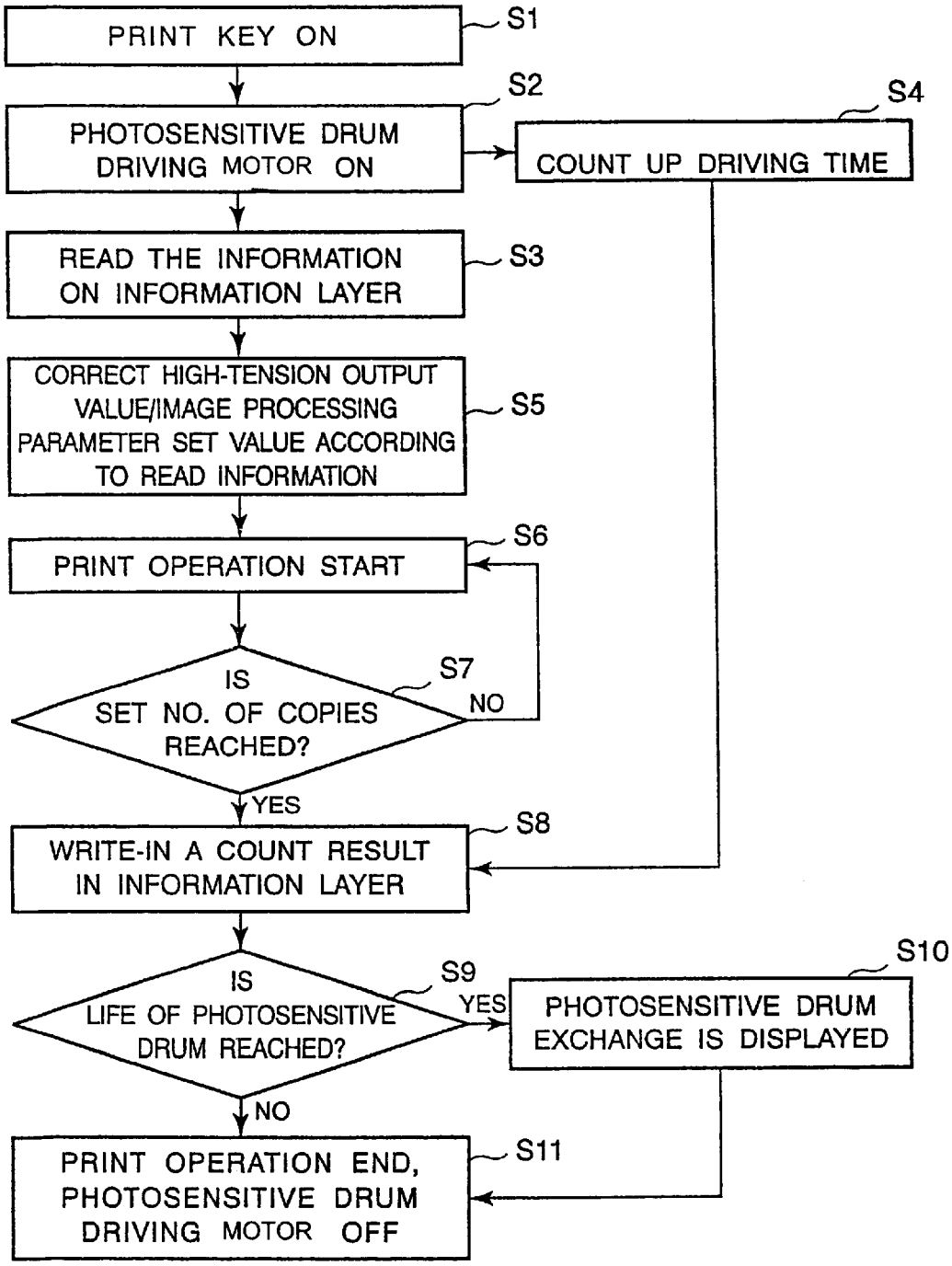
FIG. 8 is a flowchart showing the information reading/writing operation of the information recording layer in the first embodiment of this invention.

During this operation, on the information recording layer 30 of the photosensitive drums 58Y–58B, data are read/written by the optical heads 74Y–74B, initialization of the processing units 57Y–57B or the life of the photosensitive drums 58Y–58B is judged according to the flowchart shown in FIG. 8. As a result, any photosensitive drum 58Y–58B that reached the life is taken out together with the processing cartridge 28 from the image forming apparatus 100. If the main chargers 60Y–60B and the developing devices 62Y–62B did not reach the life, the photosensitive drums 58Y–58B only are exchanged with new drums and the processing cartridge 28 is installed in the main body of the image forming apparatus. If the main chargers 60Y–60B and the developing devices 62Y–62B also reached the life, whole processing cartridge is exchanged with a new unit.

When any photosensitive drum 58Y–58B or the processing cartridge 28 was exchanged, a value of high output voltage to be applied to the main charger 60Y–60B adaptable to the characteristics of new photosensitive drums 58Y–58B and an image processing parameter set value are corrected at the time of next print operation. That is, the information recorded on the information recording layer 30 on the new photosensitive drums 58Y–58B is read by the optical heads 74Y–74B and a value of high output voltage to be applied to the main chargers 60Y–60B and the image processing parameter set value are corrected according to the recorded information on the new photosensitive drums 58Y–58B.

According to this third embodiment, although the timing to exchange the photosensitive drums 58Y–58B differs because a developing agent that is used for each photosensitive drum 58Y–58B differs and the using condition also differs, it becomes possible to form the information recording layer 30 on the photosensitive drums 58Y–58B for reading/writing information by a laser beam, improve the operability during the maintenance by easily grasping information for the initialization when the photosensitive drums 58Y–58B are exchanged according to information recorded on this information recording layer 30, and accurately judge the timing for exchanging plural photosensitive drums 58Y–58B individually.

Furthermore, the information recording layer 30 does not require any countermeasure against magnetism likewise the first embodiment and a low cost requirement is achieved and also, wear that may be caused from the sliding with the optical head 24 can be prevented. In addition, the photosensitive drum 58Y–58B only can be exchange in the processing cartridge 28 and the number of component parts requiring replacement can be minimized.

This invention is not limited to the embodiments described above but can be modified variously within the spirit and scope thereof. For example, materials, structure of the information recording layer or contents of information to be recorded thereon are not limited. For the using history that is one of contents of information, a counted result of operation time of the drive motor that rotates the photosensitive drum is not used but the number of revolutions of the photosensitive drum, the number of sheets printed or a laser beam generating time, etc. are recorded and are usable as the using history. Further, the image carrier is also not limited to a drum shape but may be in a belt shape or a plate shaped supporting substrate with a photosensitive layer formed, and the arrangement of detectors for detecting information recorded on the information recording layer is also optional.

As described above, according to this invention, when an information recording layer is formed for optically reading/writing information thereon in an area other than the image forming area of the image carrier and data recorded on this information recording layer is detected, it becomes possible to initialize processing units or easily detect the life of the image carrier accurately. Furthermore, the information recording layer is without subject to the magnetic effect, not requires such magnetic countermeasures as shielding, etc., thus achieving low cost and as not contact with the optical head in the reading/writing of information, the wear resulting from the sliding with the optical head can be prevented. In addition, even when the image carrier is unitized in the processing cartridge, the image carrier only can be exchanged and the number of parts requiring replacement can be minimized.

What is claimed is:

1. An image carrier comprising:

a support base having a photosensitive layer on the surface and provided with an image forming area to form electrostatic latent images thereon; and an information recording layer formed in an area other than the image forming area on the surface of the support base for optically reading/writing information.

2. The image carrier according to claim 1, wherein the information recording layer is made of phase change optical recording material.

3. The image carrier according to claim 1, wherein the information recording layer is formed in a portion of the support base without the photosensitive layer formed.

4. The image carrier according to claim 1, wherein the information recording layer is formed by laminating on the photosensitive layer formed on the support base.

5. The image carrier according to claim 1, wherein information relative to the image carrier is recorded on the information recording layer.

6. The image carrier according to claim 5, wherein the information relative to the image carrier is a using history of the image carrier.

7. An image forming apparatus comprising:

an image carrier including a support base having a photosensitive layer on the surface and provided with an image forming area to form an electrostatic latent image thereon, and an information recording layer formed in an area other than the image forming area on the surface of the support base for optically reading/writing information;

a processing unit to execute an image forming process in the image forming area;

a detection unit to detect information recorded on the information recording layer by applying a beam to the information recording layer; and a controller to identify the status of the image carrier according to the result of detection by the detection unit.

8. The image forming apparatus according to claim 7, wherein the information recording layer is made of a phase change optical recording material.

9. The image forming apparatus according to claim 7, wherein the information recording layer is formed in a portion of the image carrier other than the photosensitive layer, and wherein the information recording layer is not formed on the support base.

10. The image forming apparatus according to claim 7, wherein the information recording layer is formed by laminating on the photosensitive layer on the support base.

11. The image forming apparatus according to claim 7, wherein the detection unit executes the read/write of information by applying a light beam to the information recording layer.

12. The image forming apparatus according to claim 7, wherein the processing unit is provided with a main charger for charging the image carrier before forming the electrostatic image on the image carrier and an exposure device for forming the electrostatic latent image on the image carrier by applying exposure light to the image carrier that is charged by the main charger;

wherein the detection unit reads out the information by applying a light beam to the information recording layer, and wherein the exposure unit writes the information by applying a light beam to the information recording layer.

13. The image forming apparatus according to claim 7, wherein the information written on the information recording layer is an image processing parameter required to control the processing unit.

14. The image forming apparatus according to claim 13, wherein the processing unit is provided with a main charger for charging the image forming area before forming the electrostatic latent image on the image carrier, wherein the image processing parameter is a value of high output voltage supplied to the main charger, and wherein the controller controls a value of high output voltage supplied to the main charger according to the image processing parameter that is obtained from the result of detection by the detection unit.

15. The image forming apparatus according to claim 13, wherein the image processing parameter is the using history of the image carrier.

16. The image forming apparatus according to claim 15, wherein the controller judges a life of the image carrier according to the using history that is obtained from the detection result of the detection unit.

17. The image forming apparatus according to claim 7, wherein the processing unit has a main charger to uniformly charge the image carrier, and wherein the image carrier and the main charger are assembled in a cartridge in one united body so that they can be exchanged.

18. An image forming apparatus comprising:

plural image carriers that are formed in areas other than the image forming areas on plural support bases provided with image forming areas on which surfaces have the photosensitive layers and electrostatic latent images are formed, having the information recording layer for information reading/writing by a light beam;

plural image carriers each of which includes a support base having a photosensitive layer on the surface and provided with an image forming area to form an electrostatic latent image thereon, and an information recording layer formed in an area other than the image forming area on the surface of the support base for optically reading/writing information;

plural processing units to execute an image forming process to the image forming areas of the plural image carriers;

plural detection units to detect information recorded on the information recording layers by applying a beam to the information recording layers; and a controller to identify the status of the plural image carriers according to the detection results of the plural detection units.

19. The image forming apparatus according to claim 18, wherein information written into the information recording layers are color information of the image forming process executed by the processing units.

* * * * *